US009412541B2

(12) United States Patent
Pisu et al.

(10) Patent No.: US 9,412,541 B2
(45) Date of Patent: Aug. 9, 2016

(54) CIRCUIT BREAKER WITH FLUID INJECTION

(71) Applicants: Francesco Pisu, Birmenstorf (CH); Francia Galindo-Lozano, Zurich (CH); Javier Mantilla, Baden (CH); Mathias-Dominic Buergler, Baden-Daettwil (CH); Nicola Gariboldi, Nussbaumen (CH); Oliver Cossalter, Fislisbach (CH); Patrick Stoller, Zurich (CH); Stephan Grob, Baden (CH); Sami Kotilainen, Niederrohrdorf (CH)

(72) Inventors: Francesco Pisu, Birmenstorf (CH); Francia Galindo-Lozano, Zurich (CH); Javier Mantilla, Baden (CH); Mathias-Dominic Buergler, Baden-Daettwil (CH); Nicola Gariboldi, Nussbaumen (CH); Oliver Cossalter, Fislisbach (CH); Patrick Stoller, Zurich (CH); Stephan Grob, Baden (CH); Sami Kotilainen, Niederrohrdorf (CH)

(73) Assignee: ABB Technology AG, Zurich (CH)

( * ) Notice: Subject to any disclaimer, the term of this patent is extended or adjusted under 35 U.S.C. 154(b) by 0 days.

(21) Appl. No.: 14/304,335

(22) Filed: Jun. 13, 2014

(65) Prior Publication Data

US 2014/0291292 A1 Oct. 2, 2014

Related U.S. Application Data

(63) Continuation of application No. PCT/EP2012/075214, filed on Dec. 12, 2012, and a continuation of application No. PCT/EP2011/072552, filed on Dec. 13, 2011, and a continuation of application No. PCT/EP2011/072553, filed on Dec. 13, 2011.

(51) Int. Cl.

| | |
|---|---|
| ***H01H 33/22*** | (2006.01) |
| ***H01H 33/90*** | (2006.01) |

(Continued)

(52) U.S. Cl.

CPC ..... *H01H 33/22* (2013.01); *H01H 33/60* (2013.01); *H01H 33/903* (2013.01); *H01H 33/91* (2013.01);

(Continued)

(58) Field of Classification Search

CPC ..... H01H 33/90; H01H 33/901; H01H 33/22; H01H 33/60; H01H 33/903; H01H 33/95; H01H 2033/908; H01H 2033/912

USPC ..... 218/51, 52, 53, 57, 59, 85, 91, 116

See application file for complete search history.

(56) References Cited

U.S. PATENT DOCUMENTS

| | | | |
|---|---|---|---|
| 3,150,245 | A | 9/1964 | Leeds et al. |
| 3,739,125 | A | 6/1973 | Noeske |

(Continued)

FOREIGN PATENT DOCUMENTS

| | | | |
|---|---|---|---|
| GB | 753375 | A | 7/1953 |
| JP | 2000224722 | A | 8/2000 |

OTHER PUBLICATIONS

International Search Report and Written Opinion of the International Searching Authority Application No. PCT/EP2012/075214 Completed: Mar. 7, 2013; Mailing Date: Mar. 14, 2013 12 pages.

*Primary Examiner* — Renee Luebke
*Assistant Examiner* — William Bolton
(74) *Attorney, Agent, or Firm* — St. Onge Steward Johnston & Reens LLC

(57) ABSTRACT

A circuit breaker including an ejection device with a compartment, in which an arc-extinction medium for improving circuit breaker operation is contained, and having an ejection orifice through which the arc-extinction medium is to be ejected, wherein the ejection orifice opens out into an injection zone of the circuit breaker in which the pressure is lower than in an arcing zone when an arc is present, and wherein the arc-extinction medium and/or exhaust-cooling medium is at least partially present in liquid form, when it is contained in the ejection device.

52 Claims, 5 Drawing Sheets

(51) Int. Cl.
*H01H 33/91* (2006.01)
*H01H 33/60* (2006.01)
*H01H 33/95* (2006.01)

(52) U.S. Cl.
CPC ..... *H01H 33/90* (2013.01); *H01H 33/901* (2013.01); *H01H 33/95* (2013.01); *H01H 2033/908* (2013.01); *H01H 2033/912* (2013.01)

(56) References Cited

U.S. PATENT DOCUMENTS 3,941,962 A 3/1976 Thaler
3,946,180 A 3/1976 Votta et al.
4,219,711 A * 8/1980 McConnell ..... 218/57
4,268,733 A * 5/1981 Garzon ..... 218/116
4,288,668 A 9/1981 Fischer et al.
4,307,274 A 12/1981 Rostron et al.
4,486,632 A * 12/1984 Niemeyer et al. ..... 218/57
4,736,080 A 4/1988 St-Jean et al.
5,001,314 A * 3/1991 Thuries et al. ..... 218/76
5,600,111 A * 2/1997 Dufournet ..... 218/61
6,207,918 B1 * 3/2001 Lorenz et al. ..... 218/59
7,763,821 B2 7/2010 Yoshitomo et al.
7,807,074 B2 * 10/2010 Luly ..... H01B 3/56 252/571
7,893,379 B2 2/2011 Schoenemann et al.
8,030,590 B2 * 10/2011 Yoshida et al. ..... 218/61
2002/0104827 A1 * 8/2002 Rokunohe ..... H01H 33/56 218/7
2003/0094437 A1 * 5/2003 Hirose et al. ..... 218/57
2009/0078680 A1 3/2009 Franck et al.
2011/0192821 A1 8/2011 Dufournet
2011/0232871 A1 * 9/2011 Flynn et al. ..... 165/104.19
2013/0277334 A1 * 10/2013 Mantilla et al. ..... 218/85
2014/0291292 A1 10/2014 Pisu et al.

* cited by examiner

CIRCUIT BREAKER WITH FLUID INJECTION

FIELD OF THE INVENTION

The present invention relates to the field of high-voltage technology, and more specifically to a circuit breaker, to a switchgear, and to a method for improved circuit breaker operation.

BACKGROUND OF THE INVENTION

In conventional circuit breakers, the arc formed during a breaking operation is normally extinguished using compressed gas. The arc extinction or interruption performance is thereby mostly defined by the blow pressure and the physical properties of the medium, e.g. the dielectric strength, the heat capacity as a function of temperature, the electronegativity and the thermal conductivity. For large ratings, compressed sulphur hexafluoride ($SF_6$) is generally used.

Typically, the arc interruption performance is improved by increasing the blow pressure of the gas using the self-blast or puffer principle. Although up to a certain rating the required interruption performance can be achieved, compressed-gas circuit breakers have intrinsic limitations that make it impossible to increase the performance without affecting product cost constraints.

Aiming at a reduction in the size, circuit breakers employing a liquefied gas, in particular $SF_6$, as the interruption medium have been proposed, e.g. in U.S. Pat. No. 3,150,245. However, the design according to U.S. Pat. No. 3,150,245 has inter alia the drawback that given the low critical temperature of $SF_6$ the respective storage vessel has to be designed for extremely high pressures.

In consideration of the drawbacks of this design, further circuit breaker using $SF_6$ have been proposed in U.S. Pat. No. 4,288,668, U.S. Pat. No. 4,307,274 and U.S. Pat. No. 4,736,080.

All these circuit breakers have in common that a relatively sophisticated ejection device is required for building up a pressure that is high enough for the insulation liquid to be ejected with the required blow pressure. For example, U.S. Pat. No. 4,307,274 discloses an operator for pumping liquid $SF_6$ and in this context mentions a typical pressure of 2'500 psi (about 170 bar).

It is clear that for these circuit breakers not only a complex pressure build-up mechanism is required, but that also the walls of the pre-injection chamber have to be designed in a manner to withstand such high pressures. Ultimately, this leads to a relatively large size and high cost of the circuit breakers.

SUMMARY OF THE INVENTION

In consideration of the above drawbacks, the objective of the present invention is to provide a circuit breaker which has improved interruption capability and which at the same time allows for a simple and economic construction and operation. This objective is achieved by the subject matter of the independent claims. More specific embodiments of the invention are given in the dependent claims.

The present invention relates to a circuit breaker comprising an ejection device, i.e. at least one ejection device, said ejection device comprising a compartment in which an arc-extinction medium and/or exhaust-cooling medium for improving circuit breaker operation, and in particular an arc-extinction medium for improving extinction of an arc formed during a breaker operation, is contained and which has an ejection orifice, i.e. at least one ejection orifice, through which the arc-extinction medium and/or exhaust-cooling medium is to be ejected. According to the invention, the ejection orifice opens out into an injection zone of the circuit breaker, in which injection zone the pressure is lower than in an arcing zone when an arc is present and the arc-extinction medium and/or exhaust-cooling medium is at least partially present in liquid form, when it is contained in the ejection device.

This allows for a very straightforward and economic design of the ejection device, since the counter-pressure against which the arc-extinction medium is to be ejected is relatively low. In particular, neither electrical means, such as an electrical power supply, nor external mechanical components are needed to pressurize and eject the arc-extinction medium.

Preferably, the ejection orifice opens out into a heating volume and/or a compression chamber of the circuit breaker for improving extinction of an arc formed during a breaker operation. Alternatively or in addition, the ejection orifice opens out into an exhaust volume of the circuit breaker for improving exhaust cooling during a breaker operation.

According to a further preferred embodiment, the arc-extinction medium is present in fully liquid form, when it is contained in the ejection device.

For clarity, the arc-extinction medium and/or exhaust-cooling medium is present in the ejection device at least partially or fully in liquid form under operating conditions of the circuit breaker, in particular under operating temperatures and/or operating pressures of the circuit breaker. Such operating conditions may depend, inter alia, on the type of circuit breaker and the currents and/or voltages to be interrupted. Such operating conditions shall encompass at least intermediate times between circuit breaker operations and/or time intervals of active circuit breaker operations, such as contact-opening and/or contact-closing, for example as occurring in a typical O—C—O sequence according to the IEC or ANSI international standard. In this context, operating temperatures shall be within a rated operating temperature range and operating pressures shall be within a rated operating pressure range of the circuit breaker.

Due to the fact that according to the present invention a liquid arc-extinction medium is ejected which instantly evaporates in the injection zone, the blow pressure present in the injection zone readily increases, which ultimately contributes to a high arc-extinction performance.

A further reason for the high arc-extinction performance lies in the fact that part of the arc energy is absorbed for vaporisation of the extinction liquid leading to improved cooling of the arc. As well, when the liquid is used for exhaust gas cooling, it readily evaporates after ejection and thus very efficiently cools the exhaust gases.

In order to safeguard that the required blow pressure can be built up, the ejection orifice is preferably a valve which only opens when a predetermined threshold pressure is reached in the compartment.

According to a particularly preferred embodiment, the circuit breaker comprises a floating piston which is designed to transmit a compressing force onto the interior of the compartment during a breaker operation. In particular, the floating piston is useful for smoothing out pressure peaks in the compression force.

As will be shown in detail below, pressure increase forcing the floating piston to move relatively to the compartment and thus transmitting the compressing force onto the compartment, can be obtained by mechanical means and/or by a pressure rise in the heating volume or compression chamber or exhaust volume due to the heating by the arc. Such compressing force can also be obtained by pressure present in a compression chamber or puffer volume, or in an exhaust volume of the circuit breaker.

According to a preferred embodiment, the ejection device is connected to a moving part of the circuit breaker such that a movement of the moving part during a breaker operation is translated into a movement of the floating piston relative to the compartment for compressing the compartment.

It is thereby particularly preferred that the ejection device further comprises an auxiliary compartment which contains a compressible medium, in particular gas, the compartment and the auxiliary compartment being separated from each other by the floating piston. In particular, the floating piston is freely floating between the compartment and the auxiliary compartment such that it is only driven by a differential pressure between the compartment and the auxiliary compartment.

In further embodiments, the circuit breaker comprises a piston for compressing the interior of the auxiliary compartment, wherein a moving part of the circuit breaker causes a relative movement between the piston and the auxiliary compartment. In particular, the auxiliary compartment can be connected to the moving part. Then the piston increases the pressure in the auxiliary compartment which in turn drives the floating piston and causes ejection of arc-extinction liquid and/or exhaust-cooling liquid from the compartment containing the arc-extinction and/or exhaust-cooling medium into the injection zone of the circuit breaker.

When the piston is moved relatively to the auxiliary compartment, the auxiliary compartment thus functions as a compressible force transmitter or gas cushion that allows smoothing out pressure peaks in the compression force to be transmitted to the floating piston, and consequently to the compartment containing the arc-extinction medium and/or exhaust-cooling. Ultimately, this allows controlling the dosing of the arc-extinction medium and/or exhaust-cooling as well as of the timeliness, duration and rate of its ejection in a very accurate manner.

The compartment containing the arc-extinction medium and/or exhaust-cooling and the auxiliary compartment functioning as a gas cushion can be arranged axially displaced from each other and/or can be arranged coaxially. Coaxial arrangement, also in combination with some axial displacement, is preferred as it allows a very simple and straightforward design of the ejection device. Thus, the circuit breaker can comprise a housing comprising the compartment and the auxiliary compartment, said housing having a cylindrical shape.

The effect of smoothing out pressure peaks is particularly pronounced when the area of the piston for compressing the interior of the auxiliary compartment is smaller than an area of the floating piston, as it is the case in a further preferred embodiment.

Additionally or alternatively to the above mechanism using a moving part of the circuit breaker, increase of the pressure acting on the floating piston can also be achieved by the heating of the gas, and thus by the pressure increase, e.g. in the heating volume or compression chamber or exhaust volume, caused by the arcing heat.

In a preferred embodiment, the floating piston is therefore designed such that its compressing force is increased when an arc is present, in particular wherein the increase is at least partially caused by an increase of the pressure in the heating volume due to the heating by the arc.

In this embodiment, the floating piston preferably comprises a primary floating piston facing the heating volume and a secondary floating piston facing the compartment, which contains the arc-extinction and/or exhaust-cooling medium, said primary floating piston and said secondary floating piston being rigidly connected to each other.

In order to avoid the building up of a counterproductive pressure between the primary floating piston and the secondary floating piston, appropriate means such as an outflow valve can be provided. Additionally or alternatively, the volume between the primary floating piston and secondary floating piston can be connected to a low pressure volume.

According to a particularly preferred embodiment, both concepts for increasing the compressing force of the floating piston, i.e. the concept of using a moving part of the circuit breaker as well as the concept of using the pressure increase in e.g. the heating volume caused by the arcing heat, can be combined with each other.

A same or similar construction as described above with a floating piston, and in particular with an auxiliary compartment as compressible force transmitter, may be present to transmit an additional compressing force onto an additional compartment, which may be present for storing and ejecting an auxiliary compound (as disclosed hereinafter).

According to a particularly preferred embodiment, the arc-extinction liquid comprises an organofluorine compound having a boiling point $T_b$ at 1 bar higher than −60° C.

According to recent findings, organofluorine compounds, and in particular fluoroketones, are able to provide arc-extinguishing performance and/or high exhaust-gas-cooling performance required for a circuit breaker.

By employing an organofluorine compound having a boiling point $T_b$ at 1 bar higher than −60° C. and thus higher than the one of $SF_6$, the arc-extinction and/or exhaust-cooling medium can be stored and ultimately ejected in liquid form without requiring sophisticated cooling and pressurizing means. This not only allows for a reduction in size of the whole design, but also leads to an increase in the interruption performance, since part of the arc energy is absorbed for vaporisation of the extinction medium which leads to improved circuit breaker operation, and in particular to improved cooling of the arc. As well, when the liquid is used for exhaust cooling, it readily evaporates after ejection and thus very efficiently cools the exhaust gases.

A further reason for improved interruption performance lies in the increased blow pressure which is generated due to the vaporisation and potentially the further decomposition of the arc extinction liquid, in particular the organofluorine compound, using the arc energy. Since several of the by-products generated by the decomposition of the organofluorine compound, and in particular the fluoroketone, are electronegative, they have good arc quenching capabilities, which further contribute to the excellent interruption performance achieved according to the present invention.

It is understood that the expression "that the arc-extinction medium comprises an organofluorine compound" is to be interpreted such that it encompasses embodiments in which a single organofluorine compound is comprised as well as embodiments in which a mixture of different organofluorine compounds is comprised.

According to a preferred embodiment, the arc-extinction liquid and/or exhaust-cooling liquid has a boiling point $T_b$ at 1 bar higher than −40° C., preferred higher than −20° C., more preferred higher than −10°, even more preferred higher than +5° C., most preferred higher than +20° C. In further embodiments, the boiling point can also be higher than +40° C., preferred higher than +65° C., most preferred higher than +90° C. This allows storage of the medium in liquid form by means of very simple cooling and/or pressurisation means or without such means at all.

The term "organofluorine compound" as used in the context of the present invention is to be understood broadly and means a compound containing at least one carbon atom and at least one fluorine atom. It is understood that these compounds can optionally comprise further atoms, in particular at least one atom selected from the group consisting of oxygen, hydrogen, nitrogen, and iodine, in addition to carbon and fluorine. The present invention encompasses both embodiments where the arc-extinction liquid is at least essentially consisting of the organofluorine compound as well as embodiments comprising further components.

Specifically, the arc-extinction and/or exhaust-cooling liquid comprises as organofluorine compound preferably at least one compound selected from the group consisting of: a fluorocarbon, in particular $C_2F_6$ and $C_3F_8$; a hydrofluorocarbon; a fluoroether; a fluoroamine; a fluoroketone; and mixtures thereof.

Herein, the term "fluoroether", "fluoroamine" and "fluoroketone" refer to at least partially fluorinated compounds. In particular, the term "fluoroether" encompasses both hydrofluoroethers and perfluoroethers, the term "fluoroamine" encompasses both hydrofluoroamines and perfluoroamines, and the term "fluoroketone" encompasses both hydrofluoroketones and perfluoroketones.

It is thereby preferred that the fluorocarbon, the fluoroether, the fluoroamine and the fluoroketone are fully fluorinated, i.e. perfluorinated. They are thus devoid of any hydrogen which—in particular in view of the potential by-products, such as hydrogen fluoride, generated by decomposition—is generally considered unwanted in circuit breakers.

According to a particularly preferred embodiment, the arc-extinction liquid comprises as organofluorine compound a fluoroketone or a mixture of fluoroketones, in particular a fluoromonoketone.

Fluoroketones have recently been found to have excellent dielectric insulation properties. They have now been found to have also excellent interruption properties.

The term "fluoroketone" as used in the context of the present invention shall be interpreted broadly and shall encompass both perfluoroketones and hydrofluoroketones. The term shall also encompass both saturated compounds and unsaturated compounds including double and/or triple bonds between carbon atoms. The at least partially fluorinated alkyl chain of the fluoroketones can be linear or branched and can optionally form a ring.

The term "fluoroketone" shall encompass compounds that may comprise in-chain heteroatoms. In exemplary embodiments, the fluoroketone shall have no in-chain hetero atom. The term "fluoroketone" shall also encompass fluorodiketones having two carbonyl groups or fluoroketones having more than two carbonyl groups. In exemplary embodiments, the fluoroketone shall be a fluoromonoketone.

According to a preferred embodiment, the fluoroketone is a perfluoroketone. It is preferred that the fluoroketone has a branched alkyl chain. It is also preferred that the fluoroketone is fully saturated.

Preferably, the fluoroketone contains from 5 to 15 carbon atoms, preferably from 5 to 9, more preferably exactly 5, exactly 6 or exactly 7 or exactly 8 carbon atoms. The respective fluoroketones have a relative high boiling point and thus allow storage of the medium in liquid form by means of very simple cooling and/or pressurisation means or no such means at all.

According to a particularly preferred embodiment, the fluoroketone has exactly 5 carbon atoms and is selected from the group consisting of the compounds defined by the following structural formulae in which at least one hydrogen atom is substituted with a fluorine atom:

(Ia)

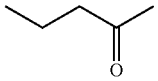

(Ib)

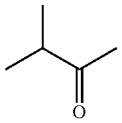

(Ic)

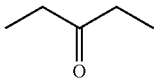

(Id)

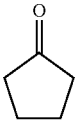

Compared to fluoroketones having a lower chain length with less than 5 carbon atoms, fluoroketones containing 5 carbon atoms have the advantage of a relatively high boiling point, allowing to maintain it in liquid form by means of very simple cooling and/or pressurisation means or no such means at all. Fluoroketones containing exactly 5 carbon atoms have the further advantage that they are generally non-toxic.

In a particularly preferred embodiment, the fluoroketone has the molecular formula $C_5F_{10}O$, i.e. is fully saturated without any double or triple bond. The fluoroketone may more preferably be selected from the group consisting of 1,1,1,3,4,4,4-heptafluoro-3-(trifluoromethyl)butan-2-one (also named decafluoro-3-methylbutan-2-one), 1,1,1,3,3,4,4,5,5,5-Decafluoropentan-2-one, 1,1,1,2,2,4,4,5,5,5-decafluoropentan-3-one, 1,1,1,4,4,5,5,5,-octafluoro-3-bis(trifluoromethyl)-pentan-2-one; and most preferably is 1,1,1,3,4,4,4-heptafluoro-3-(trifluoromethyl)butan-2-one.

Among the fluoroketones containing exactly 5 carbon atoms, 1,1,1,3,4,4,4-heptafluoro-3-(trifluoromethyl)butan-2-one, here briefly cited by the generic term "C5-ketone" (=fluoroketone containing exactly 5 carbon atoms), with molecular formula $CF_3C(O)CF(CF_3)_2$ (or sum formula $C_5F_{10}O$), has been found to be particularly preferred because it has the advantages of a high dielectric insulation performance, in particular in mixtures with a dielectric carrier gas component, a very low GWP and a low boiling point. It has an ozone depletion potential of 0 and is practically non-toxic.

1,1,1,3,4,4,4-heptafluoro-3-(trifluoromethyl)butan-2-one can be represented by the following structural formula (I):

(I)

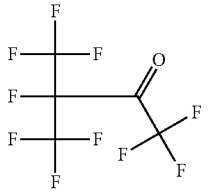

According to a further preferred embodiment, the fluoroketone has exactly 6 carbon atoms and is at least one compound selected from the group consisting of the compounds defined by the following structural formulae in which at least one hydrogen atom is substituted with a fluorine atom:

(IIa)

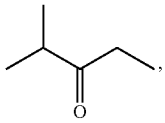

(IIb)

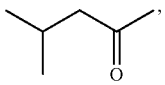

(IIc)

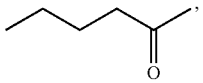

(IId)

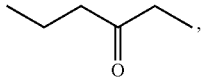

(IIe)

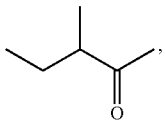

(IIf)

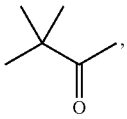

and (IIg)

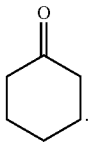

According to a further preferred embodiment, the fluoroketone has exactly 7 carbon atoms and is at least one compound selected from the group consisting of the compounds defined by the following structural formulae in which at least one hydrogen atom is substituted with a fluorine atom:

(IIIa)

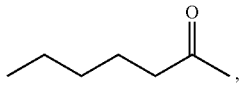

(IIIb)

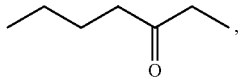

(IIIc)

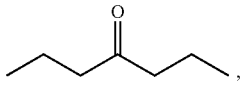

(IIId)

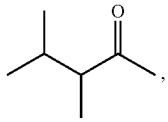

(IIIe)

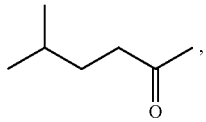

(IIIf)

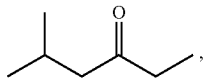

(IIIg)

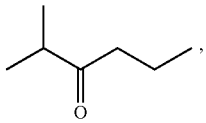

(IIIh)

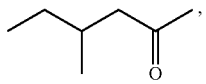

(IIIi)

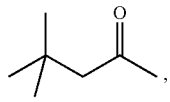

(IIIj)

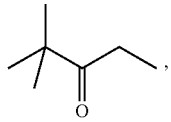

(IIIk)

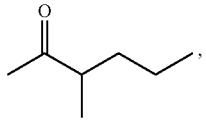

(IIIl)

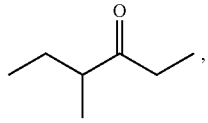

(IIIm)

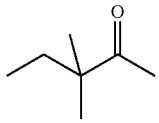

and

-continued (IIIn)

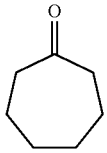

named dodecafluoro-cycloheptanone.

The present invention encompasses each compound or combination of compounds selected from the group consisting of the compounds according to structural formulae Ia to Id, IIa to IIg, IIIa to IIIn.

A fluoroketone containing exactly 6 carbon atoms is particularly preferred for the purpose of the present invention due to its relatively high boiling point. Also, fluoroketones having exactly 6 carbon atoms are non-toxic with outstanding margins for human safety.

In particular, the fluoroketone has the molecular formula $C_6F_{12}O$. More preferably, the fluoroketone is selected from the group consisting of 1,1,1,2,4,4,5,5,5-nonafluoro-2-(trifluoromethyl)pentan-3-one (also named dodecafluoro-2-methylpentan-3-one), 1,1,1,3,3,4,5,5,5-nonafluoro-4-(trifluoromethyl)pentan-2-one (also named dodecafluoro-4-methylpentan-2-one), 1,1,1,3,4,4,5,5,5-nonafluoro-3-(trifluoromethyl)pentan-2-one (also named dodecafluoro-3-methylpentan-2-one), 1,1,1,3,4,4,4-heptafluoro-3-bis-(trifluoromethyl)butan-2-one (also named dodecafluoro-3,3-(dimethyl)butan-2-one), dodecafluorohexan-2-one and dodecafluorohexan-3-one, and particularly is the mentioned 1,1,1,2,4,4,5,5,5-nonafluoro-2-(trifluoromethyl)pentan-3-one.

1,1,1,2,4,4,5,5,5-Nonafluoro-2-(trifluoromethyl)pentan-3-one (also named dodecafluoro-2-methylpentan-3-one or perfluoro-2-methyl-3-pentanone) can be represented by the following structural formula (II):

(II)

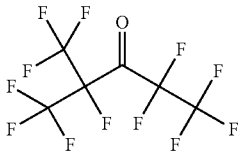

1,1,1,2,4,4,5,5,5-Nonafluoro-4-(trifluoromethyl)pentan-3-one, here briefly cited by the more generic term "C6-ketone" (=fluoroketone comprising exactly 6 carbon atoms), with molecular formula $C_2F_5C(O)CF(CF_3)_2$ (or sum formula $C_6F_{12}O$) has been found to be particularly preferred.

It has a boiling point of 49.2° C. at 1 bar and can thus be kept in liquid form by means of very simple cooling and/or pressurisation means or without such means at all.

1,1,1,2,4,4,5,5,5-Nonafluoro-4-(trifluoromethyl)pentan-3-one has further been found to have high insulating properties and an extremely low GWP. It has an ozone depletion potential of 0 and is non-toxic (LC50 of about 100'000 ppm). Thus, the environmental impact is much lower than with conventional insulation gases, and at the same time outstanding margins for human safety are achieved.

As will be discussed in detail below, the present invention encompasses embodiments of the circuit breaker comprising an improved ejection device which allows for an accurate control of the dosing of the medium as well as of the timeliness, duration and rate of its ejection. In this regard, the ejection device is preferably designed such that the arc-extinction medium and/or exhaust-cooling medium is ejected at a rate in a range from 0 ml/ms, in particular 0.1 ml/ms, to 15 ml/ms, preferably from 1 ml/ms to 10 ml/ms, more preferably from 3 ml/ms to 6 ml/ms.

It is further preferred that the ejection device is designed such that the arc-extinction medium and/or exhaust-cooling medium is ejected during an ejection time shorter than 25 ms (milliseconds), preferably during an ejection time in a range from 5 ms to 15 ms, more preferably during an ejection time of about 10 ms.

According to a further preferred embodiment the circuit breaker comprises a dielectric insulation medium comprising an organofluorine compound which is at least partially in gaseous state at operational conditions. Specifically, the dielectric insulation medium is comprised outside the ejection device. Thus, increased insulating properties can be achieved. The term dielectric insulation medium here also encompasses arc-extinction capability of the medium.

In particular, the organofluorine compound comprised in the dielectric insulation medium corresponds to the organofluorine compound comprised in the arc-extinction liquid and/or exhaust-cooling liquid and more particularly stems therefrom. Again, it is understood that the expression "comprising an organofluorine compound" is to be interpreted such that it encompasses embodiments in which a single organofluorine compound is comprised as well as embodiments in which a mixture of different organofluorine compounds is comprised.

According to a further preferred embodiment at least one background gas is present in the circuit breaker selected from the group consisting of: $CO_2$, $N_2$, $O_2$, $SF_6$, $CF_4$, a noble gas, in particular Ar, and mixtures thereof. When using an arc-extinction liquid comprising a fluoroketone as in the above described preferred embodiment in combination with a background, in particular a background gas as defined above, also the insulation performance of the background gas can be improved due to the high dielectric strength of the gaseous fluoroketone obtained by vaporization of the arc-extinction liquid using the arc energy and/or due to the high dielectric strength of its decomposition products. As well, when the arc-extinction liquid and specifically the fluoroketone liquid is used for exhaust cooling, it readily evaporates after ejection, possibly decomposes and thus very efficiently cools the exhaust gases.

BRIEF DESCRIPTION OF THE DRAWINGS

The invention is further illustrated by the following examples, in combination with the figures which show exemplarily and schematically in.

DETAILED DESCRIPTION OF THE INVENTION

Figure 1:
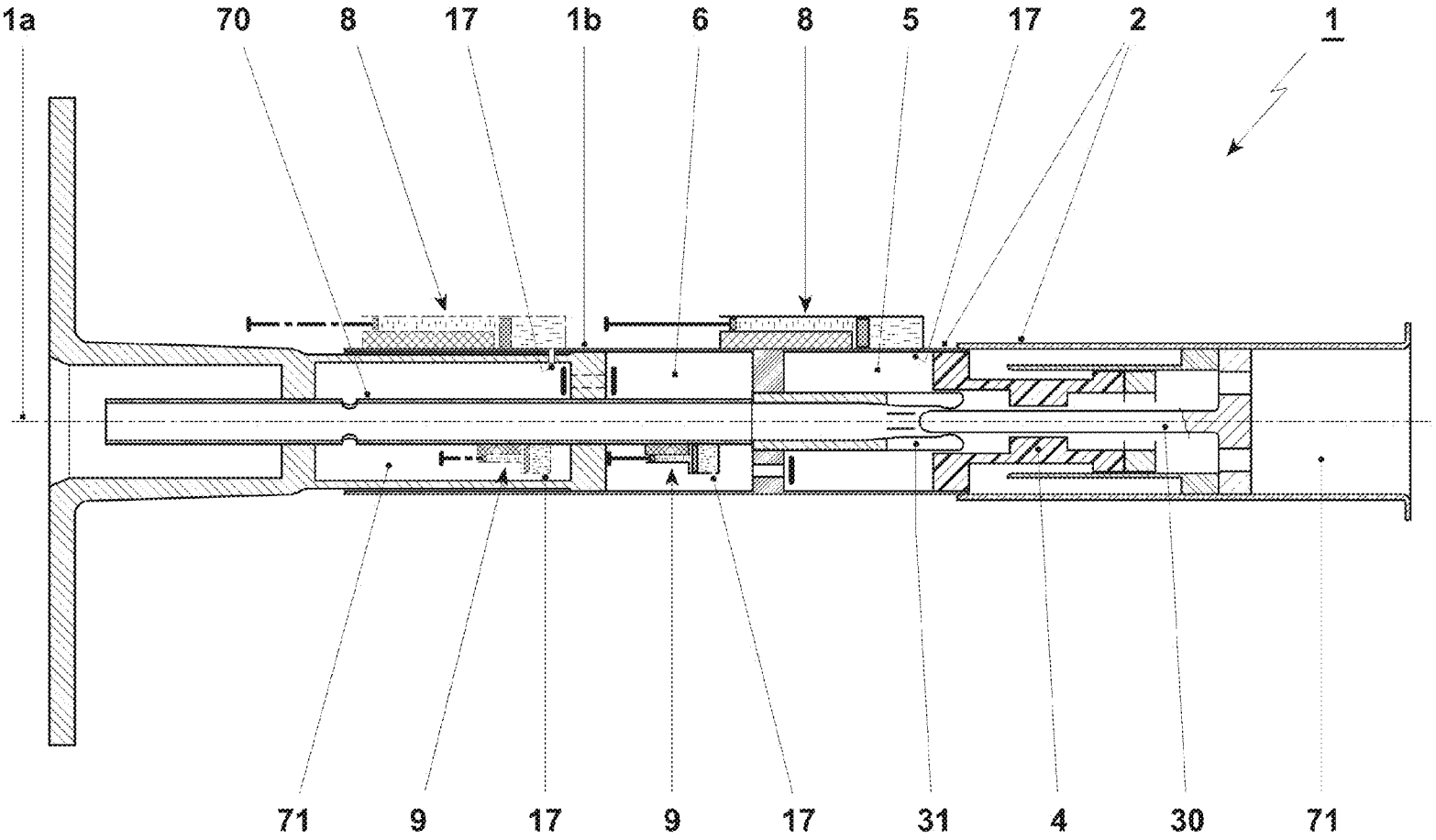
FIG. 1 a circuit breaker with an outside ejection device or inside ejection device.

FIG. 1 shows schematically an exemplary circuit breaker 1 having a central axis 1*a*, an enclosure 1*b*, nominal contacts 2, arcing contacts 30, 31, in particular a plug 30 and tulip 31 which provide in opened state between them an arcing zone 32 (see FIG. 2, 3), and an insulating material nozzle 4. The circuit breaker 1 has further a puffer volume or compression chamber 6 and optionally, if it is a self-blast circuit breaker 1, a heating volume or heating chamber 5. It also has an exhaust tube 70 which leads exhaust gases into an exhaust volume 71. The exhaust volume 71 can also be present on the side of the arcing pin or plug 30. FIG. 1 also indicates that the circuit breaker 1 has a novel ejection device outside 8 or inside 9 the circuit breaker enclosure 1*b*.

Figure 2:
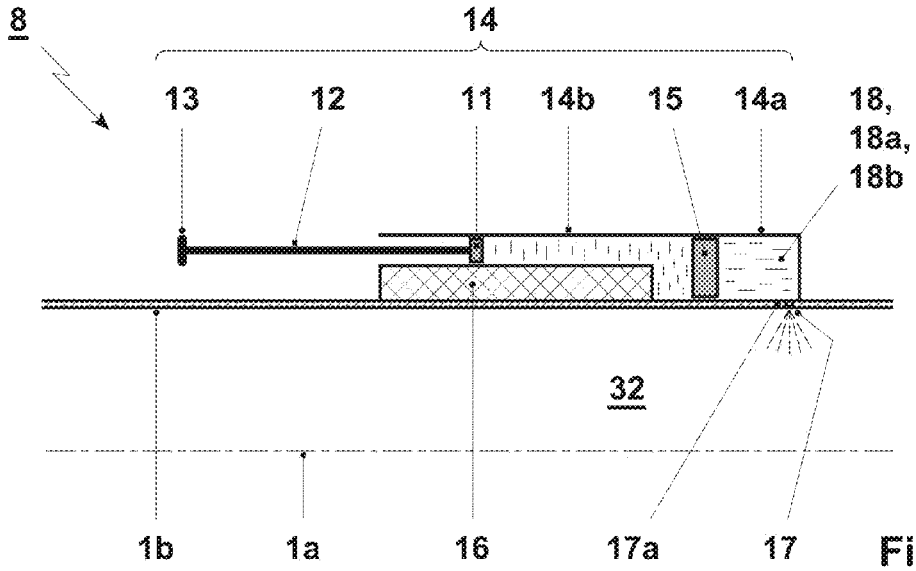
FIG. 2 an outside ejection device with a compression mechanism according to a first embodiment of the invention.

FIG. 2 shows a first embodiment of an outside ejection device 8 with a compression mechanism 14 comprising a compartment 14*a* for arc-extinction medium 18; 18*a*, 18*b*, in particular arc-extinction liquid 18; 18*a*, 18*b*. The arc-extinction medium 18; 18*a*, 18*b* contained in compartment 14*a* comprises or is for example an organofluorine compound having a boiling point $T_b$ at 1 bar higher than −60° C.

The ejection device further comprises an auxiliary compartment 14*b* separated from and mechanically connected to the compartment 14*a* by a floating piston 15, and a mechanically driven piston 11 of the auxiliary compartment 14*b*. The compression mechanism 14 according to FIG. 2 is arranged outside the circuit breaker enclosure 1*b*. The compartment 14*a* serves for receiving, storing and ejecting the arc-extinction medium 18; 18*a*, 18*b* under pressure. As shown, the piston 11 can e.g. be fixedly supported on a wall 13 while the compression mechanism 14, in particular the auxiliary compartment 14*b*, is moveable, typically along the operating axis 1*a* of the circuit breaker.

Preferably, the ejection device 8, in particular the compression mechanism 14, is mechanically connected to a moving part 16 of the circuit breaker 1. During a breaker operation a movement of the moving part 16 is translated into a relative movement between the auxiliary compartment 14*b* and the piston 11 for compressing the auxiliary compartment 14*b* such that a volume of the auxiliary compartment 14*b* is reduced. Thus the pressure inside the auxiliary compartment 14*b* increases. This increased pressure is applied via the floating piston 15 onto the liquid ejection compartment 14*a* so that there the pressure rises, as well.

Figure 3:
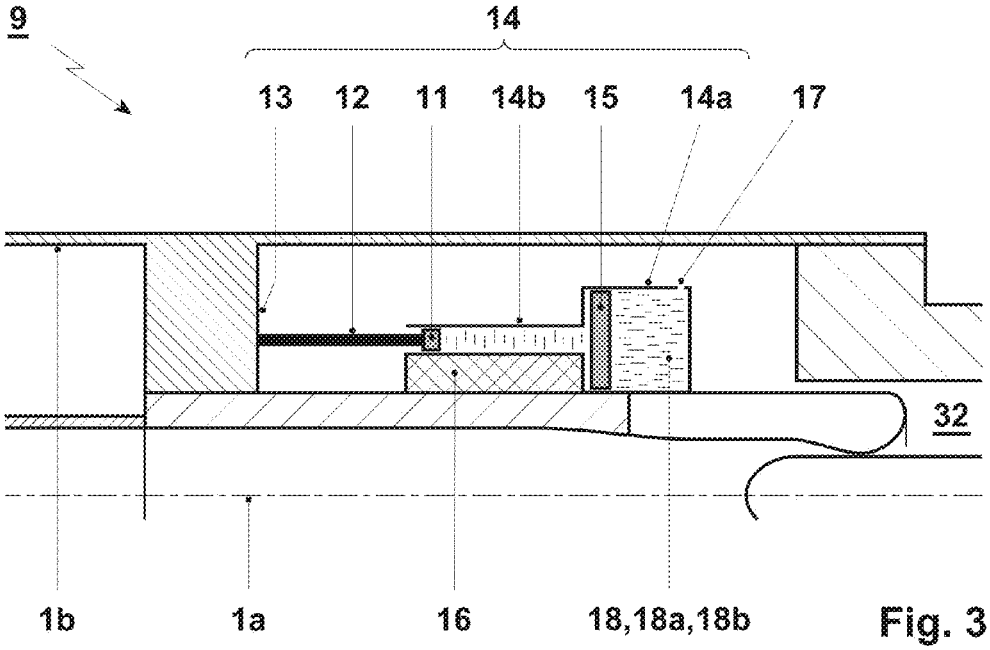
FIG. 3 an inside ejection device with a compression mechanism according to a second embodiment of the invention.

FIG. 3 shows a second embodiment of an inside ejection device 9 with a compression mechanism 14 comprising a compartment 14*a* for the arc-extinction medium 18; 18*a*, 18*b*, in particular the arc-extinction liquid 18; 18*a*, 18*b*, an auxiliary compartment 14*b* separated from and mechanically connected to the compartment 14*a* by a floating piston 15, and a mechanically driven piston 11 of the auxiliary compartment 14*b*. The ejection device 9 and in particular the compression mechanism 14 is now arranged inside the circuit breaker enclosure 1*b*. The functions of the elements, in particular the moveable mechanism 14, the preferably fixed piston 11, the liquid compartment 14*a* and the auxiliary compartment 14*b* are as described above for FIG. 1.

In both embodiments of FIGS. 1 and 2, the pressure in the compartment 14*a* filled with the incompressible arc-extinction medium 18; 18*a*, 18*b*, typically a liquid 18; 18*a*, 18*b*, is increased by the compressive force exerted onto the interior of the compartment 14*a* via the externally driven piston 11. As a result the arc-extinction medium is ejected through the ejection orifice 17 out of the compartment 14*a* into an injection zone 5, 6, 71.

The injection zone can be any zone of the circuit breaker 1 in which the pressure is lower than in an arcing zone 32 when an arc is present. In particular, the injection zone 5, 6, 71 can be a heating volume 5, a puffer volume 6 or an exhaust volume 71.

In both FIGS. 1 and 2, the auxiliary compartment 14*b* is filled with a compressible medium, in particular a gas, and serves for transmitting a compression force to the compartment 14*a* and thereby to pressurize and eventually eject arc-extinction liquid 18; 18*a*, 18*b* into an injection zone 5, 6, 71 or possibly arcing zone 32 of the circuit breaker 1. The auxiliary compartment 14*b* as disclosed herein functions as a compressible force transmitter or gas cushion that allows to smoothen out pressure peaks in the compression force to be transmitted to the liquid compartment 14*a*. Thus the timeliness, amount and dosing of the arc-extinction medium or liquid 18; 18*a*, 18*b* is improved considerably over previously known ejection devices.

Figure 4A:
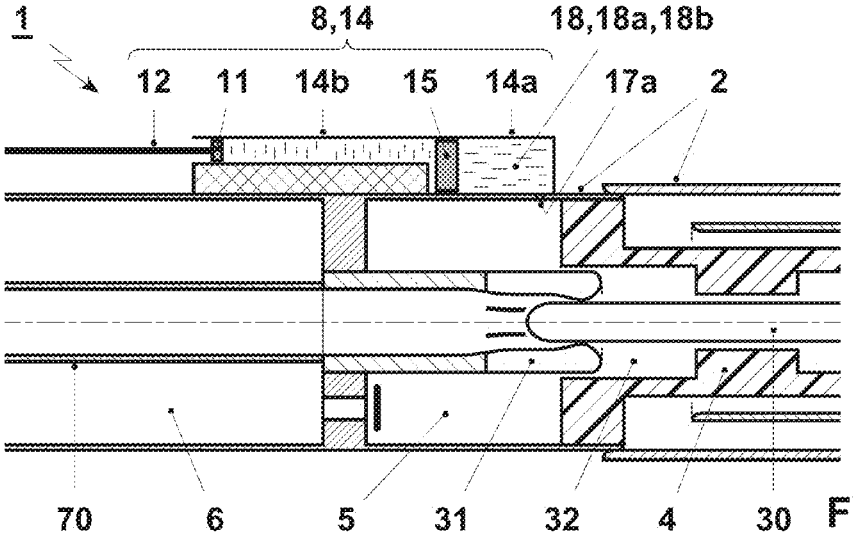
FIG. 4*a*, 4*b*, 4*c* three operating states of the outside ejection device of FIG. 2.
Figure 4B:
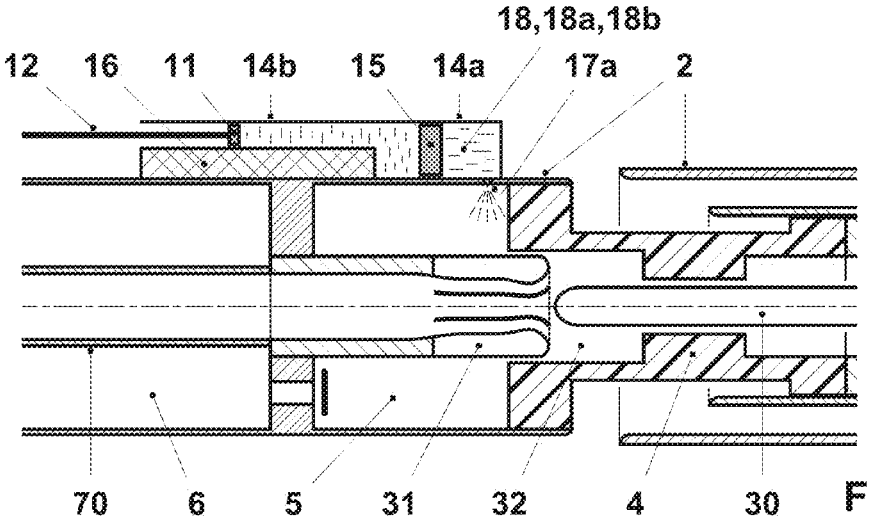
Figure 4C:
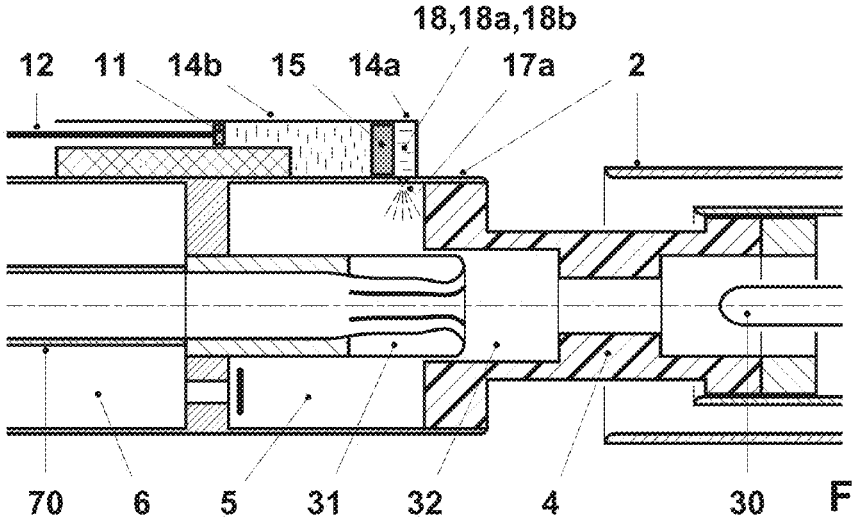

FIG. 4*a*, 4*b*, 4*c* show three operating states of the circuit breaker 1 and of the ejection devices 8, 9 here shown for the outside ejection device 8. With increasing contact separation an arc forms, the pressure in the auxiliary compartment 14*b* is increased by the advancing decrease of the volume of the auxiliary compartment 14*b* due to the breaker movement of circuit breaker 1 and is smoothly transmitted to the liquid compartment 14*a*. Continuously or upon traversing a pressure limit, if the ejection orifice is or has a valve 17, arc-extinction fluid 18; 18*a*, 18*b* is ejected and is injected into any or several of the aforementioned injection zones 5, 6, 71, in the shown embodiment, particularly into the heating volume 5. After release out of the liquid compartment 14*a*, the arc-extinction medium 18; 18*a*, 18*b* vaporizes and then improves the extinguishing performance of the breaker with highest efficiency.

Figure 5:
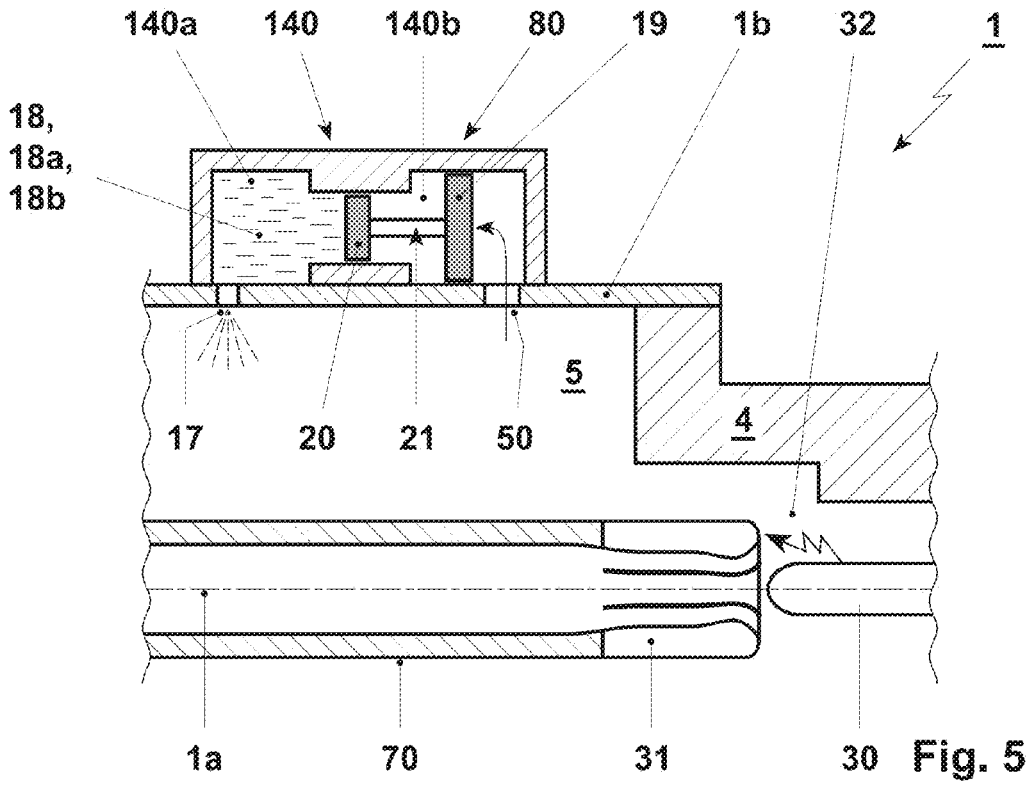
FIG. 5 an outside ejection device with another compression mechanism according to a third embodiment of the invention.

FIG. 5 shows another variant of an outside ejection device 80 of a circuit breaker 1 having an axis 1*a*, an enclosure 1*b*, arcing contacts, in particular a plug (not shown) and a tulip 31, which provide in opened state between them an arcing zone 32. In analogy to the embodiment shown e.g. in FIG. 1, also the embodiment shown in FIG. 5 comprises an insulating material nozzle 4*a* and an exhaust tube 70 which leads exhaust gases into an exhaust volume 71. Generally, the exhaust volume 71 may also exist on the side of the plug 30, and the exhaust gas may be guided into the exhaust volume 71 by passing through the main nozzle 4 or through a hollow plug 30.

According to the variant shown in FIG. 5, floating piston 21, which is acting on and is compressing compartment 140*a* containing the arc-extinction medium, is driven by gas pressure present in the circuit breaker 1 during a breaker operation, and in particular is driven by gas pressure present in the heating volume 5 of a self-blast circuit breaker 1. To this end, ejection device 80 is connected to the heating volume 5 via a pressure opening 50.

If due to the compressing force exerted on compartment 140*a* a pressure limit is exceeded, valve 17 opens such that arc-extinction medium 18; 18*a*, 18*b*, in particular arc-extinction liquid 18; 18*a*, 18*b*, is ejected out of liquid compartment 140*a* and is injected into the heating volume 5.

Figure 6:
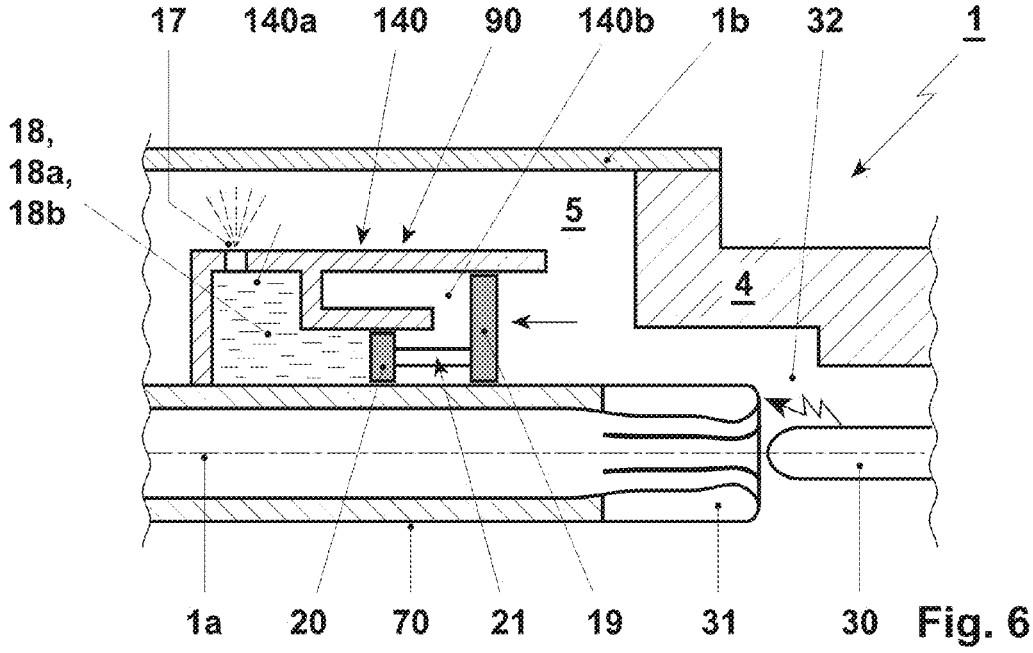
FIG. 6 an inside ejection device with yet another compression mechanism according to a fourth embodiment of the invention, and FIG. 7*a*, 7*b*, 7*c* an ejection device comprising an auxiliary chamber for injection of an auxiliary injection compound.

FIG. 6 shows a further variant similar to the one shown in FIG. 5 but with an inside ejection device 90 which operates as described above.

According to both embodiments shown in FIGS. 5 and 6, the floating piston 21 is guided in a piston guidance 140*b* and comprises a primary floating piston 19 which transmits compressing force from the heating chamber 5 onto a secondary floating piston 20, said secondary floating piston 20 transmitting compressing force to the compartment 14*a* containing the arc-extinction medium 18; 18*a*, 18*b* in particular the arc-extinction liquid 18; 18*a*, 18*b*. The primary floating piston 19 is rigidly connected to the secondary floating piston 20. Given the design of the primary floating piston having a larger area than the secondary floating piston 20 a high injection pressure can also be achieved even if the movement of the primary floating piston is relatively small. The blow pressure in the heating volume 5 is further increased by evaporation of the arc-extinction liquid 18; 18*a*, 18*b* upon release into the heating volume 5.

When an arc is present, the pressure in the heating volume 5 is increased due to the heating of the gas by the burning arc. Since the ejection device 80 is connected to the heating volume 5 via the pressure opening 50, the floating piston moves from a remote position in relation to the compartment 140*a*, thereby compressing the interior of the compartment 140*a*. Continuously, or upon traversing a pressure limit if the ejection orifice is or has a valve 17, arc-extinction fluid 18 is ejected and is injected into any or several of the aforementioned injection zones 5, 6, 71, in the shown embodiment, particularly into the heating volume 5, as shown in FIG. 1-6. After release out of the liquid compartment 140*a*, the arc-extinction medium 18 vaporizes and then improves the extinguishing performance of the circuit breaker 1 with highest efficiency.

The circuit breaker 1 can be, e.g., a high voltage circuit breaker, a generator circuit breaker, a medium voltage circuit breaker, or any other electrical switch which requires active arc extinction, as e.g. a load break switch.

In embodiments, an ejection device 8, 9; 80, 90—as disclosed in FIG. 1-6 and in the description thereof for an arc-extinction medium 18; 18*a*, 18*b* which serves for improving extinction of an arc burning temporarily in the arcing zone 32 of the circuit breaker 1—can also be used when being arranged close to or inside of or outside of the exhaust volume 71 of the circuit breaker, as indicated in FIG. 1, and when containing an exhaust-cooling medium 18; 18*a*, 18*b*. Please note that the arc-extinction medium 18 may also serve as the exhaust-cooling medium 18; 18*a*, 18*b* and vice versa, and both media 18; 18*a*, 18*b* can be or can comprise the same compound or compounds and, in particular, can be identical. Herein, exhaust volume is any volume of the circuit breaker that is connected downstream of the arcing zone and is for outflowing exhaust gases.

Figure 7A:
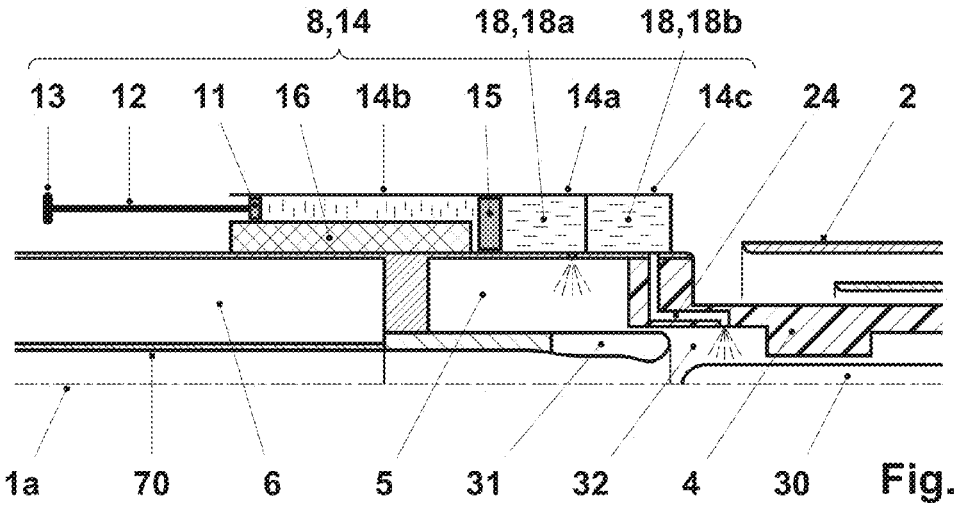
Figure 7B:
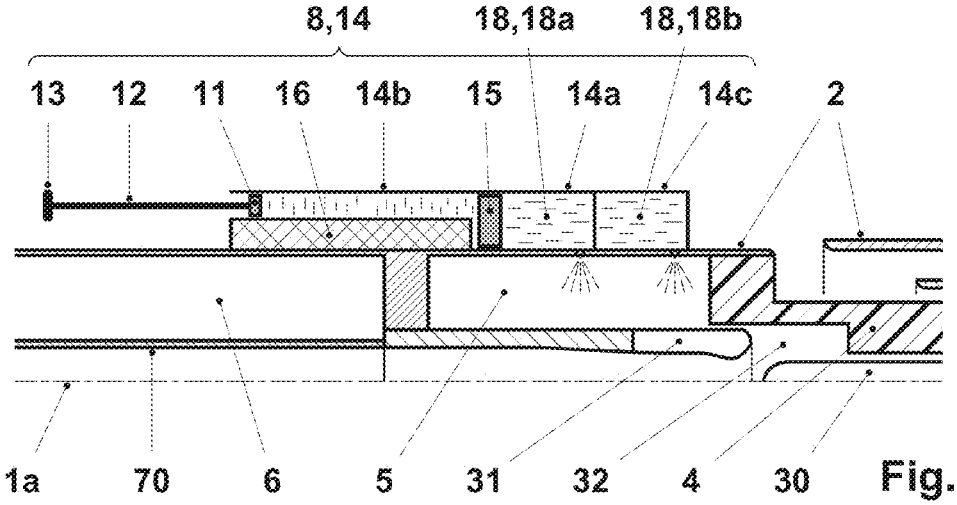
Figure 7C:
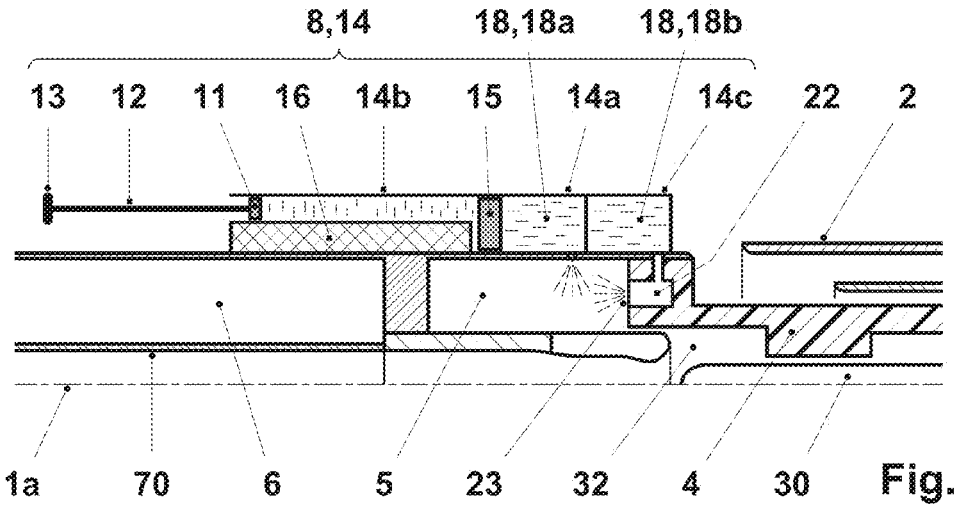

A further aspect of the invention is disclosed in connection with FIGS. 7*a*, 7*b* and 7*c*. Embodiments relate to a circuit breaker 1, in particular a circuit breaker 1 as disclosed above, with the circuit breaker 1 comprising an ejection device 8, 9; 80, 90 comprising an arc-extinction medium 18; 18*b* for improving extinction of an arc formed during a breaker operation, wherein the arc-extinction medium 18; 18*b* contained in the ejection device 8, 9; 80, 90 comprises an auxiliary injection compound 18*b* selected from the group consisting of: $O_2$, $CO_2$, $N_2$, $CF_4$, a noble gas, in particular argon, and mixtures thereof. This allows to create a locally increased concentration of the auxiliary injection compound 18*b* in the arcing zone 32 and to enhance the thermal and/or dielectric interruption capability of the circuit breaker.

In a preferred embodiment the arc extinction medium 18 contained in the ejection device 8, 9; 80, 90 is or comprises oxygen 18*b*. This may serve for boosting an arc-blowing pressure in the arcing zone 32. The auxiliary injection compound 18*b* and in particular oxygen 18*b* as an example can namely trigger additional effects between the components of the gas mixture in the arcing zone 32 which leads to an increased pressure build-up and enhances the extinction capability of the circuit breaker 1.

In an embodiment, and as exemplarily shown in FIG. 7*a*-7*c*, the ejection device 8, 9; 80, 90 can comprise an additional compartment 14*c* in which the arc-extinction medium 18; 18*b* is contained and which has an ejection orifice 17 through which the auxiliary injection compound 18*b*, in particular oxygen 18*b*, is to be ejected. The additional compartment 14*c* may also be pressurized indirectly via an or the above mentioned auxiliary compartment (not shown in FIG. 7*a*-7*c*), in particular for smoothening out pressure peaks in the compression force to be transmitted to a or the above mentioned floating piston and for accurately controlling the dosing of the auxiliary injection compound 18*b*, in particular oxygen 18*b*, and the timeliness, duration and rate of its ejection.

FIG. 7*a* shows an embodiment, in which the auxiliary injection compound 18*b*, in particular oxygen 18*b*, is to be injected directly into an arcing zone 32 of the circuit breaker 1 via an auxiliary injection channel 24. In particular, the auxiliary injection channel 24 can be arranged in close proximity to the arcing zone 32 such that temperatures of the auxiliary compound 18*b* above 2000 K are achievable when the auxiliary compound 18*b* is injected into the auxiliary injection channel 24 during a contact-opening operation of the circuit breaker 1.

FIGS. 7*b* and 7*c* show embodiments, in which the auxiliary injection compound 18*b*, in particular oxygen 18*b*, is to be injected indirectly via a or the heating volume 5 and/or compression volume 6 and/or via an auxiliary volume 22. In particular, the auxiliary volume 22 can be arranged in close proximity to the arcing zone 32 such that temperatures of the auxiliary compound 18*b* above 2000 K are achievable when the auxiliary compound 18*b* is injected into the auxiliary volume 22 during a contact-opening operation of the circuit breaker 1.

The auxiliary volume 22 for temporarily receiving and transmitting the auxiliary injection compound 18*b* has the following advantages: When there is high current arcing, as may occur during severe short-circuits (such as T60 and higher) in a circuit breaker 1, for example a self-blast and/or puffer circuit breaker 1, the arcing zone 32 may mainly be filled with ablated PTFE ($C_2F_4$, Teflon) that displaces the gas mixture with which the circuit breaker 1 is filled. In this case, direct injecting of oxygen is likely to be less efficient and not to the full extent to create the additional effect that result in increased pressure build-up. Therefore, indirect injection into the heating volume 5 and/or compression volume 6 and/or auxiliary volume 22 is done.

In particular, the auxiliary volume 22 is fluidly connected via an auxiliary intermediate channel (not explicitly shown in FIG. 7*c*), an auxiliary opening 23 or an auxiliary valve 23 to a or the heating volume 5 and/or compression chamber 6 for transmitting the auxiliary compound 18*b* to the arcing zone 32.

In an embodiment, timing means for timed injection of the auxiliary compound 18*b*, in particular oxygen 18*b*, into the arcing zone 32 can be present such that a or the boosting of the arc-blowing pressure occurs close to current-zero, in particular in a time window of less than 15 ms, preferably less than 10 ms, more preferably less than 5 ms, and most preferred less than 3 ms, around the time instant when current-zero occurs. Such timed injection allows to create the boost in pressure in close time-relationship to current-zero when the high pressure is most beneficial. The timing means may for example comprise an timing control for operating an ejection orifice valve 17 and/or an auxiliary valve 23 for the auxiliary volume 22.

Such valve timing control may comprise valves 17, 23 that are actively operated, for example based on information about operational timing or operational conditions of the circuit breaker, or that are passively operated, for example by the pressures and/or temperatures present under operating conditions in the circuit breaker. Alternatively or in addition, the timing means may for example also comprise other passive timing control, such as a time-delaying injection channel 17*a*, and/or a time-delaying auxiliary intermediate channel between auxiliary volume 22 and heating volume 5 or compression chamber 6, and/or a time-delaying auxiliary injection channel (to be present at position 23 in FIG. 7*c*).

While there are shown and described presently preferred embodiments of the invention, it is to be distinctly understood that the invention is not limited thereto but may otherwise variously be embodied and practised within the scope of the following claims. Therefore, terms like "preferred", "preferably", "in particular", "particularly" or "advantageously" signify optional and exemplary embodiments only. As well, reference numerals are not meant to be limiting but exemplary only.

LIST OF REFERENCE NUMERALS

1 circuit breaker
1*a* axis (of circuit breaker)
1*b* enclosure (of circuit breaker), chamber wall, heating chamber wall, compression chamber wall
2 nominal contacts
30, 31 arcing contacts
30 plug
31 tulip
32 arcing zone
4 nozzle
5, 6, 71 injection zone
5 heating volume, heating chamber
50 pressure opening
6 puffer volume, compression chamber
70 exhaust tube
71 exhaust volume
8, 9; 80, 90 ejection device
8, 80 outside ejection device
9, 90 inside ejection device
11 piston, mechanically driven piston
12 rod, mechanical connection
13 support
14, 140 compression mechanism
14*a*, 140*a* compartment, liquid compartment
14*b*, auxiliary compartment, gas compartment, gas cushion compartment
140*b* piston guidance
14*c* additional compartment of ejection device 8, 9; 80, 90 for auxiliary injection compound
15, 21 floating piston
16 moving part of interrupter, movement transmitter
17 ejection orifice; valve, outlet valve, ejection valve, injection nozzle, spray nozzle
17*a* injection opening, injection channel
18 arc-extinction medium, arc-extinction liquid
18*a* fluoroketone, mixture of fluoroketones, fluoromonoketone
18*b* auxiliary injection compound; $O_2$, $CO_2$, $N_2$, $CF_4$, a noble gas
19 primary piston, primary floating piston
20 secondary piston, secondary floating piston
22 auxiliary volume for receiving auxiliary compound, pre-heating-up volume for the auxiliary compound
23 auxiliary intermediate channel, auxiliary opening, auxiliary valve
24 auxiliary injection channel.
$T_b$ boiling point (at 1 bar), boiling temperature of arc-extinction liquid, boiling temperature of exhaust-cooling liquid

What is claimed is:

1. A circuitbreaker comprising at least one ejection device, said ejection device comprising a compartment, in which an arc-extinction medium and/or exhaust-cooling medium for improving circuit breaker operation is contained, and having at least one ejection orifice through which the arc-extinction medium and/or exhaust-cooling medium is to be ejected, wherein the ejection orifice opens out into an injection zone of the circuit breaker in which the pressure is lower than in an arcing zone when an arc is present, and wherein the arc-extinction medium and/or exhaust-cooling medium is at least partially present in liquid form, when it is contained in the ejection device, wherein the arc-extinction medium and/or exhaust-cooling medium comprises an organofluorine compound having a boiling point Tb at 1 bar higher than −60° C., wherein the organofluorine compound comprises a fluoroketone or a mixture of fluoroketones, including a fluoromonoketone.

2. The circuit breaker according to claim 1, wherein the organofluorine compound comprises in addition at least one atom selected form the group consisting of oxygen, hydrogen, nitrogen, and iodine.

3. The circuit breaker according to claim 1, wherein the fluoromonoketone contains 5 to 15 carbon atoms.

4. The circuit breaker according to claim 1, wherein the fluoromonoketone contains from 5 to 9 carbon atoms.

5. The circuit breaker according to claim 1, wherein the fluoromonoketone contains exactly 5 or exactly 6 or exactly 7 or exactly 8 carbon atoms.

6. The circuit breaker according to claim 1, wherein at least one background gas is present which is selected from the group consisting of: $CO_2$, $N_2$, $O_2$, $SF_6$, $CF_4$, a noble gas, and mixtures thereof.

7. The circuit breaker according to claim 1, wherein the circuit breaker is a high voltage circuit breaker, a medium voltage circuit breaker, a generator circuit breaker, or a load-break switch.

8. The circuit breaker according to claim 1, wherein the boiling point Tb at 1 bar is higher than −10° C.

9. A circuitbreaker comprising at least one ejection device, said ejection device comprising a compartment, in which an arc-extinction medium and/or exhaust-cooling medium for improving circuit breaker operation is contained, and having at least one ejection orifice through which the arc-extinction medium and/or exhaust-cooling medium is to be ejected, wherein the ejection orifice opens out into an injection zone of the circuit breaker in which the pressure is lower than in an arcing zone when an arc is present, and wherein the arc-extinction medium and/or exhaust-cooling medium is at least partially present in liquid form, when it is contained in the ejection device, wherein the ejection device is designed such that the arc-extinction medium and/or exhaust-cooling medium is ejected at a rate in a range from 0.1 ml/ms to 15 ml/ms.

10. The circuit breaker according to claim 9, wherein the circuit breaker further comprises, outside the ejection device, a dielectric insulation medium comprising an organofluorine compound selected from the group consisting of: a fluoroether; a fluoroamine; a fluoroketone; and mixtures thereof, wherein the organofluorine compound is at least partially in gaseous state at operational conditions of the circuit breaker.

11. The circuit breaker according to claim 9, wherein at least one background gas is present which is selected from the group consisting of: $CO_2$, $N_2$, $O_2$, $SF_6$, $CF_4$, a noble gas, and mixtures thereof.

12. The circuit breaker according to claim 9, wherein the circuit breaker is a high voltage circuit breaker, a medium voltage circuit breaker, a generator circuit breaker, or a load-break switch.

13. A gas-insulated switchgear, comprising a circuit breaker according to claim 9.

14. The circuit breaker according to claim 9, wherein the ejection device is designed such that the arc-extinction medium and/or exhaust-cooling medium is ejected at a rate in a range from 1 ml/ms to 10 ml/ms.

15. The circuit breaker according to claim 9, wherein the ejection device is designed such that the arc-extinction medium and/or exhaust-cooling medium is ejected at a rate in a range from 3 ml/ms to 6 ml/ms.

16. The circuit breaker according to any claim 9, wherein the arc-extinction medium and/or exhaust-cooling medium comprises an organofluorine compound having a boiling point Tb at 1 bar higher than −60° C.

17. The circuit breaker according to claim 9, wherein the arc-extinction medium and/or exhaust-cooling medium comprises a fluoromonoketone containing 5 to 15 carbon atoms.

18. The circuit breaker according to claim 17, wherein the fluoromonoketone contains from 5 to 9 carbon atoms.

19. The circuit breaker according to claim 17, wherein the fluoromonoketone contains exactly 5 or exactly 6 or exactly 7 or exactly 8 carbon atoms.

20. A circuitbreaker comprising at least one ejection device, said ejection device comprising a compartment, in which an arc-extinction medium and/or exhaust-cooling medium for improving circuit breaker operation is contained, and having at least one ejection orifice through which the arc-extinction medium and/or exhaust-cooling medium is to be ejected, wherein the ejection orifice opens out into an injection zone of the circuit breaker in which the pressure is lower than in an arcing zone when an arc is present, and wherein the arc-extinction medium and/or exhaust-cooling medium is at least partially present in liquid form, when it is contained in the ejection device, wherein the ejection device is designed such that the arc-extinction medium and/or exhaust-cooling medium is ejected during an ejection time shorter than 25 ms.

21. The circuit breaker according to claim 20, wherein the circuit breaker further comprises, outside the ejection device, a dielectric insulation medium comprising an organofluorine compound selected from the group consisting of: a fluoroether; a fluoroamine; a fluoroketone; and mixtures thereof, wherein the organofluorine compound is at least partially in gaseous state at operational conditions of the circuit breaker.

22. The circuit breaker according to claim 20, wherein at least one background gas is present which is selected from the group consisting of: $CO_2$, $N_2$, $O_2$, $SF_6$, $CF_4$, a noble gas, and mixtures thereof.

23. The circuit breaker according to claim 20, wherein the circuit breaker is a high voltage circuit breaker, a medium voltage circuit breaker, a generator circuit breaker, or a load-break switch.

24. A gas-insulated switchgear, comprising a circuit breaker according to claim 20.

25. The circuit breaker according to claim 20, wherein the ejection time is in a range from 5 ms to 15 ms.

26. The circuit breaker according to claim 20, wherein the ejection time is about 10 ms.

27. The circuit breaker according to any claim 20, wherein the arc-extinction medium and/or exhaust-cooling medium comprises an organofluorine compound having a boiling point Tb at 1 bar higher than −60° C.

28. The circuit breaker according to claim 20, wherein the arc-extinction medium and/or exhaust-cooling medium comprises a fluoromonoketone containing 5 to 15 carbon atoms.

29. The circuit breaker according to claim 28, wherein the fluoromonoketone contains from 5 to 9 carbon atoms.

30. The circuit breaker according to claim 28, wherein the fluoromonoketone contains exactly 5 or exactly 6 or exactly 7 or exactly 8 carbon atoms.

31. A circuitbreaker comprising at least one ejection device, said ejection device comprising a compartment, in which an arc-extinction medium and/or exhaust-cooling medium for improving circuit breaker operation is contained, and having at least one ejection orifice through which the arc-extinction medium and/or exhaust-cooling medium is to be ejected, wherein the ejection orifice opens out into an injection zone of the circuit breaker in which the pressure is lower than in an arcing zone when an arc is present, and wherein the arc-extinction medium and/or exhaust-cooling medium is at least partially present in liquid form, when it is contained in the ejection device, the circuit breaker or the ejection device comprising an arc-extinction medium for improving extinction of an arc formed during a breaker operation, wherein the arc-extinction medium when contained in the ejection device comprises an auxiliary injection compound selected from the group consisting of: $O_2$, $CO_2$, $N_2$, $CF_4$, a noble gas, and mixtures thereof, wherein the auxiliary injection compound is to be injected indirectly into the arcing zone via a heating volume and/or a compression volume and/or via an auxiliary volume, wherein the auxiliary volume is arranged in close proximity to the arcing zone such that temperatures of the auxiliary compound above 2000 K are achievable when the auxiliary compound is injected into the auxiliary volume during a contact-opening operation of the circuit breaker.

32. The circuit breaker according to claim 31, wherein the circuit breaker further comprises, outside the ejection device, a dielectric insulation medium comprising an organofluorine compound selected from the group consisting of: a fluoroether; a fluoroamine; a fluoroketone; and mixtures thereof, wherein the organofluorine compound is at least partially in gaseous state at operational conditions of the circuit breaker.

33. The circuit breaker according to claim 32, wherein the organofluorine compound comprises in addition at least one atom selected form the group consisting of oxygen, hydrogen, nitrogen, and iodine.

34. The circuit breaker according to claim 32, wherein the organofluorine compound comprises a fluoromonoketone containing 5 to 15 carbon atoms.

35. The circuit breaker according to claim 31, wherein at least one background gas is present which is selected from the group consisting of: $CO_2$, $N_2$, $O_2$, $SF_6$, $CF_4$, a noble gas, and mixtures thereof.

36. The circuit breaker according to claim 31, wherein the circuit breaker is a high voltage circuit breaker, a medium voltage circuit breaker, a generator circuit breaker, or a load-break switch.

37. A gas-insulated switchgear, comprising a circuit breaker according to claim 31.

38. The circuit breaker according to claim 31, wherein timing means for timed injection of the auxiliary compound into the arcing zone are present such that a boosting of arc-blowing pressure occurs in a time window of less than 15 ms.

39. The circuit breaker according to claim 38, wherein the boosting of the arc-blowing pressure occurs in a time window of less than 10 ms.

40. The circuit breaker according to claim 38, wherein the boosting of the arc-blowing pressure occurs in a time window of less than 5 ms.

41. The circuit breaker according to claim 38, wherein the boosting of the arc-blowing pressure occurs in a time window of less than 3 ms.

42. A circuitbreaker comprising at least one ejection device, said ejection device comprising a compartment, in which an arc-extinction medium and/or exhaust-cooling medium for improving circuit breaker operation is contained, and having at least one ejection orifice through which the arc-extinction medium and/or exhaust-cooling medium is to be ejected, wherein the ejection orifice opens out into an injection zone of the circuit breaker in which the pressure is lower than in an arcing zone when an arc is present, and wherein the arc-extinction medium and/or exhaust-cooling medium is at least partially present in liquid form, when it is contained in the ejection device, the circuit breaker or the ejection device comprising an arc-extinction medium for improving extinction of an arc formed during a breaker operation, wherein the arc-extinction medium when contained in the ejection device comprises an auxiliary injection compound selected from the group consisting of: $O_2$, $CO_2$, $N_2$, $CF_4$, a noble gas, and mixtures thereof, wherein timing means for timed injection of the auxiliary compound into the arcing zone are present such that a boosting of arc-blowing pressure occurs close to current-zero.

43. The circuit breaker according to claim 42, wherein the circuit breaker further comprises, outside the ejection device, a dielectric insulation medium comprising an organofluorine compound selected from the group consisting of: a fluoroether; a fluoroamine; a fluoroketone; and mixtures thereof, wherein the organofluorine compound is at least partially in gaseous state at operational conditions of the circuit breaker.

44. The circuit breaker according to claim 43, wherein the organofluorine compound comprises in addition at least one atom selected form the group consisting of oxygen, hydrogen, nitrogen, and iodine.

45. The circuit breaker according to claim 43, wherein the organofluorine compound comprises a fluoromonoketone containing 5 to 15 carbon atoms.

46. The circuit breaker according to claim 42, wherein at least one background gas is present which is selected from the group consisting of: $CO_2$, $N_2$, $O_2$, $SF_6$, $CF_4$, a noble gas, and mixtures thereof.

47. The circuit breaker according to claim 42, wherein the circuit breaker is a high voltage circuit breaker, a medium voltage circuit breaker, a generator circuit breaker, or a load-break switch.

48. A gas-insulated switchgear, comprising a circuit breaker according to claim 42.

49. The circuit breaker according to claim 42, wherein the boosting of the arc-blowing pressure occurs in a time window of less than 15 ms.

50. The circuit breaker according to claim 42, wherein the boosting of the arc-blowing pressure occurs in a time window of less than 10 ms.

51. The circuit breaker according to claim 42, wherein the boosting of the arc-blowing pressure occurs in a time window of less than 5 ms.

52. The circuit breaker according to claim 42, wherein the boosting of the arc-blowing pressure occurs in a time window of less than 3 ms.

* * * * *